US010034363B2

(12) United States Patent
Roy et al.

(10) Patent No.: US 10,034,363 B2
(45) Date of Patent: Jul. 24, 2018

(54) NITROPHOBIC SURFACE FOR EXTREME THRUST GAIN

(71) Applicant: University of Florida Research Foundation, Gainesville, FL (US)

(72) Inventors: Subrata Roy, Gainesville, FL (US); Kirk Jeremy Ziegler, Gainesville, FL (US)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 124 days.

(21) Appl. No.: 15/155,322

(22) Filed: May 16, 2016

(65) Prior Publication Data

US 2016/0338185 A1 Nov. 17, 2016

Related U.S. Application Data

(60) Provisional application No. 62/162,190, filed on May 15, 2015.

(51) Int. Cl.
*F15C 1/06* (2006.01)
*H05H 1/24* (2006.01)

(52) U.S. Cl.
CPC ... *H05H 1/2406* (2013.01); *H05H 2001/2418* (2013.01); *H05H 2240/10* (2013.01)

(58) Field of Classification Search
CPC ..... H05H 1/2406; H05H 2001/2418; H05H 2240/10
USPC ..... 137/825, 827; 149/110, 111, 114; 244/74; 261/5, 64.1, 96, 100; 313/231.31; 315/111.61
See application file for complete search history.

(56) References Cited

U.S. PATENT DOCUMENTS 8,235,072 B2 8/2012 Roy
8,944,370 B2 * 2/2015 Khozikov ..... F03H 1/0012 244/73 R
8,957,572 B2 * 2/2015 Eden ..... H05H 1/2406 219/121.36
8,999,039 B2 * 4/2015 Hilbig ..... B01D 53/228 95/130
9,220,162 B2 * 12/2015 Takenoshita ..... H05H 1/2406
9,536,709 B2 * 1/2017 Koyama ..... H05H 1/2406
(Continued)

FOREIGN PATENT DOCUMENTS

WO 2011156408 A2 12/2011

OTHER PUBLICATIONS

Nelson, P.H. & Auerbach, S.M. Self-Diffusion in Single-File Zeolite Membranes is Fickian at Long Times. J. Chem. Phys. 110, 9235 (1999).

(Continued)

*Primary Examiner* — Minh Le
(74) *Attorney, Agent, or Firm* — Thomas | Horstemeyer, LLP

(57) ABSTRACT

The present disclosure describes a new type of selective nitrophobic surface membrane in a plasma actuator that separates oxygen from nitrogen in the atmosphere, thereby increasing the presence of oxygen near an exposed electrode of the plasma actuator. Accordingly, the plasma flow created in the presence of oxygen at the exposed electrode generates more force than plasma flow created in the presence of nitrogen.

20 Claims, 11 Drawing Sheets

(56) References Cited

U.S. PATENT DOCUMENTS

| | | | | |
|---|---|---|---|---|
| 2005/0103193 | A1* | 5/2005 | Lyons | B01D 53/22 95/54 |
| 2007/0089795 | A1* | 4/2007 | Jacob | B64C 23/005 137/827 |
| 2013/0038199 | A1* | 2/2013 | Roy | H05H 1/24 313/231.31 |
| 2014/0321987 | A1* | 10/2014 | Nolcheff | F01D 17/00 415/148 |
| 2015/0305132 | A1* | 10/2015 | Mitra | H05H 1/48 313/231.31 |
| 2016/0200618 | A1* | 7/2016 | Boughton | C03B 5/025 501/52 |
| 2017/0165630 | A1* | 6/2017 | Buchanan | B01J 19/088 |
| 2018/0065690 | A1* | 3/2018 | Han | B62D 35/02 |

OTHER PUBLICATIONS

Nelson, P.H. & Auerbach, S.M. Modeling Tracer Counter-Permeation through Anisotropic Zeolite Membranes: From Mean-Field Theory to Single-File Diffusion. Chem. Eng. J. 74, 43 (1999).

Keffer, D. The temperature dependence of single-file separation mechanisms in one-dimensional nanoporous materials. Chem. Eng. J. 74, 33 (1999).

Patel, H.A., Je, S.H., Park, J., Chen, D.P., Jung, Y., Yavuz, C.T. & Coskun, A. Unprecedented high-temperature CO2 selectivity in N-2-phobic nanoporous covalent organic polymers. Nature Communications 4 (2013).

Sridhar, S., Smitha, B. & Aminabhavi, T.M. Separation of Carbon Dioxide from Natural Gas Mixtures through Polymeric Membranes—A Review. Separation and Purification Reviews 36, 113 (2007).

Du, N.Y. Park, H.B., Dal-Cin, M.M. & Guiver, M.D. Advances in high permeability polymeric membrane materials for CO2 separations. Energy & Environmental Science 5, 7306 (2012).

Mckeown, N.B. & Budd, P.M. Exploitation of Intrinsic Microporosity in Polymer-Based Materials. Macromolecules 43, 5163 (2010).

Furukawa, H., Ko, N., Go, Y.B., Aratani, N., Choi, S.B., Choi, E., Yazaydin, A.O., Snurr, R.Q., O'keeffe, M., Kim, J. & Yaghi, O.M. Ultrahigh Porosity in Metal-Organic Frameworks. Science 329, 424 (2010).

Keskin, S. & Sholl, D.S. Screening Metal—Organic Framework Materials for Membrane-based Methane/Carbon Dioxide Separations. The Journal of Physical Chemistry C 111, 14055 (2007).

Cong, H., Radosz, M., Towler, B.F. & Shen, Y. Polymer-inorganic nanocomposite membranes for gas separation. Separation and Purification Technology 55, 281 (2007).

Adams, R., Carson, C., Ward, J., Tannenbaum, R. & Koros, W. Metal organic framework mixed matrix membranes for gas separations. Microporous and Mesoporous Materials 131, 13 (2010).

Kiyono, M., Williams, P.J. & Koros, W.J. Effect of pyrolysis atmosphere on separation performance of carbon molecular sieve membranes. J Membrane Sci 359, 2 (2010).

Ismail, A.F. & David, L.I.B. A review on the latest development of carbon membranes for gas separation. J Membrane Sci 193, 1 (2001).

Yuan, J.Y. & Antonietti, M. Poly(ionic liquid)s: Polymers expanding classical property profiles. Polymer 52, 1469 (2011).

Lin, B. Meron, M., Cui, B. & Rice, S.A. From Random Walk to Single-File Diffusion. Phys. Rev. Left. 94, 216001 (2005).

Hinds, B.J., Chopra, N., Rantell, T., Andrews, R., Gavalas, V. & Bachas, L.G. Aligned Multiwalled Carbon Nanotube Membranes. Science 303, 62 (2004).

Majumder, M., Chopra, N. & Hinds, B.J. Effect of Tip Functionalization on Transport through Vertically Oriented Carbon Nanotube Membranes. J. Am. Chem. Soc. 127, 9062 (2005).

Xia, Y., Yang, P., Sun, Y., Wu, Y., Mayers, B., Gates, B., Yin, Y., Kim, F. & Yan, H. One-dimensional nanostructures: synthesis, characterization, and applications. Adv. Mater. 15, 353 (2003).

Jessensky, O., Muller, F. & Gosele, U. Self-organized formation of hexagonal pore arrays in anodic alumina. Applied Physics Letters 72, 1173 (1998).

Arnold, D.C., Hobbs, R.G., Zirngast, M., Marschner, C., Hill, J.J., Ziegler, K.J., Morris, M.A. & Holmes, J.D. Single step synthesis of Ge-SiOx core-shell heterostructured nanowires. J. Mater. Chem. 19, 954 (2009).

Crowley, T.A., Ziegler, K.J., Lyons, D.M., Erts, D., Olin, H., Morris, M.A. & Holmes, J.D. Synthesis of metal and metal oxide nanowire and nanotube arrays within a mesoporous silica template. Chem. Mater. 15, 3518 (2003).

Ziegler, K. Ryan, K.M., Rice, R. Crowley, T., Erts, D., Olin, H., Patterson, J., Spalding, T.R., Holmes, J.D. & Morris, M.A. The synthesis of matrices of embedded semiconducting nanowires. Faraday Discuss. 125, 311 (2004).

Gudiksen, M.S. & Lieber, C.M. Diameter-selective synthesis of semiconductor nanowires. J. Am. Chem. Soc. 122, 8801 (2000).

Holmes, J.D., Johnston, K.P., Doty, R.C. & Korgel, B.A. Control of thickness and orientation of solution-grown silicon nanowires. Science 287, 1471 (2000).

Wu, Y., Cui, Y., Huynh, L., Barrelet, C.J., Bell, D.C. & Lieber, C.M. Controlled growth and structures of molecular-scale silicon nanowires. Nano Lett. 4, 433 (2004).

Krutyeva, M., Vasenkov , S., Yang , X., Caro, J. & Kärger, J. Surface barriers on nanoporous particles: A new method of heir quantitation by PFG NMR. Microporous and Mesoporous Materials 104, 89 (2007).

* cited by examiner

NITROPHOBIC SURFACE FOR EXTREME THRUST GAIN

CROSS-REFERENCE TO RELATED APPLICATIONS

This application claims priority to, U.S. Provisional Application entitled "NITROPHOBIC SURFACE FOR EXTREME THRUST GAIN," filed on May 15, 2015, and assigned application No. 62/162,190, which is incorporated herein by reference in its entirety.

TECHNICAL FIELD

The present disclosure is generally related to plasma actuators.

BACKGROUND

In general, a plasma actuator may induce the flow of a fluid, such as air or any other type of fluid in which the plasma actuator is located, due to the electro-hydrodynamic (EHD) body force that results from the electric field lines that are generated between electrodes of the plasma actuator.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

The present disclosure describes various types of plasma actuators and related methods that utilize membranes for selectively passing oxygen particles, such as nitrophobic membrane(s).

Non-limiting examples of plasma actuators are described in U.S. Pat. No. 8,235,072, titled "Method and Apparatus for Multibarrier Plasma High Performance Flow Control," issued on Aug. 7, 2012, U.S. Publication No. 2013/0038199, titled "System, Method, and Apparatus for Microscale Plasma Actuation," filed on Apr. 21, 2011, and WIPO Publication No. WO/2011/156408, titled "Plasma Inducted Fluid Mixing," filed on Jul. 6, 2011. Each of these documents is incorporated by reference herein in its entirety.

Embodiments of the present disclosure utilize a new highly efficient type of selective membrane in a plasma actuator for the separation of oxygen from air and the enhanced thrust from generated plasma flow. Such a membrane structure can selectively enrich a top side of the plasma actuator with more oxygen thereby improving performance of the plasma actuator.

Studies have shown that plasma flow created in the presence of oxygen ($O_2$) generates more force than plasma flow created in the presence of nitrogen ($N_2$). Therefore, performance of the plasma actuator is improved by depleting nitrogen particles and enriching oxygen particles at a top surface of the plasma actuator near an exposed electrode. Further, not only is more oxygen generated in the neighborhood of the plasma actuator, the pressure drop or differential across the membrane structure is increased to great effect and benefit.

In one embodiment, an azo-covalent organic polymer material with nitrogen selectivity is utilized as plasma actuator material to increase plasma force due to substantial increase in majority oxygen atmosphere. In such an embodiment, the plasma actuator is, but not limited to, an atmospheric plasma actuator.

Experimental evidence suggests that a majority (~98%) of plasma generated electric force is due to atomic and molecular oxygen gas, and its metastable and ionized forms. As such, nitrophobic surface increases oxygen concentration in a scalable fashion helping to improve plasma force. Additionally, the nitrophobic surface of an exemplary plasma actuator causes significant pressure differential due to nitrogen repulsion. Such pressure differential may generate an additional lifting force of about 2-4 Newtons for even a 70 mm diameter plate (see FIG. 2). This gain is not possible with standard plasma actuation. Accordingly, nitrophobic plasma actuator technology is envisioned to be extremely valuable to the flow control and propulsion community.

Figure 1:
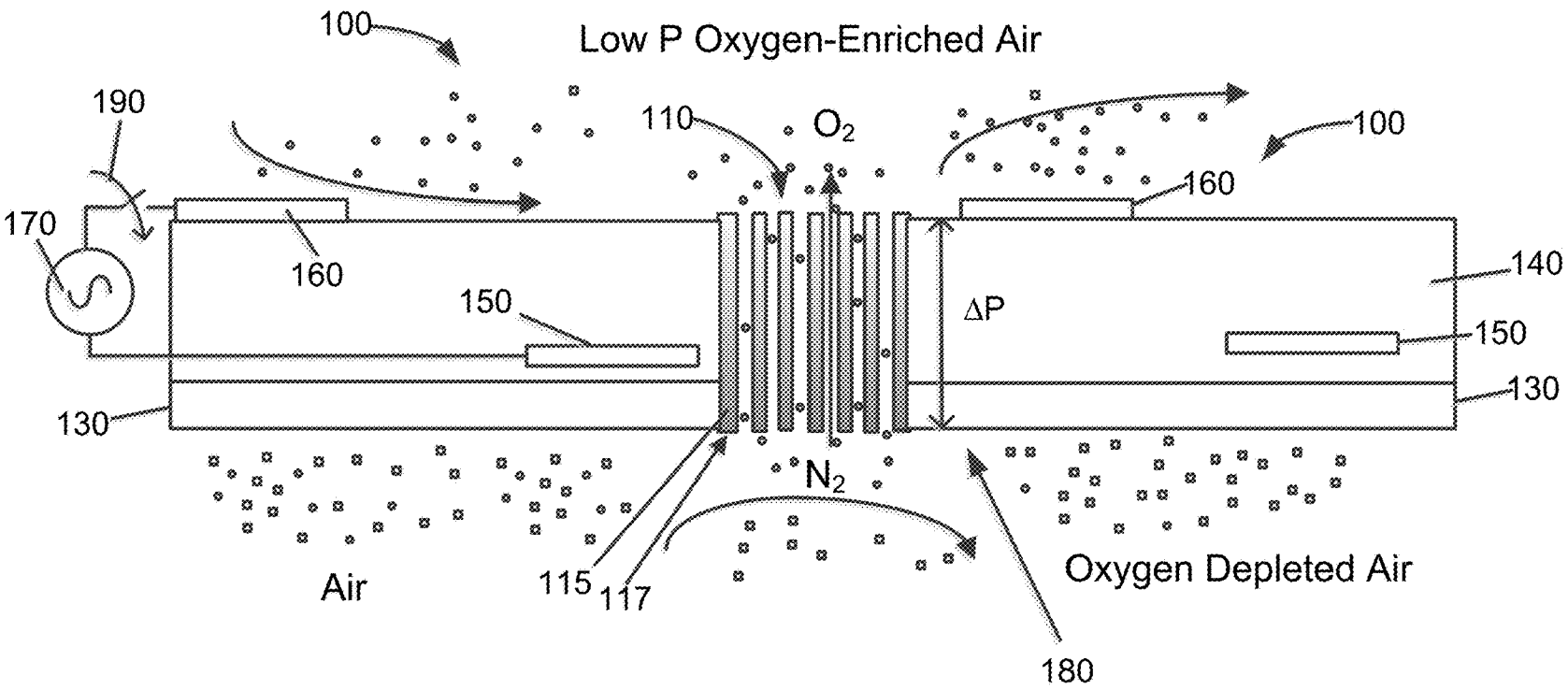
FIG. 1 is a diagram of an embodiment of a plasma actuator having a nitrophobic surface membrane structure in accordance with the present disclosure.

Referring now to FIG. 1, one embodiment of a plasma actuator 100 having a nitrophobic surface membrane structure 110 is shown. Accordingly, upon a frame substrate or material 130, a dielectric material 140 is disposed, such as polyimide aerogel. Embedded in the dielectric material 140 is a buried electrode 150 for each plasma actuator 100. An exposed electrode 160 is provided on the surface of the dielectric material 140 which may be powered by a voltage source 170, as shown. The exposed electrode 160 is surrounded by the atmosphere, such as air. However, in accordance with the present disclosure, oxygen-enriched air is produced and surrounds the exposed electrode 160 via the membrane structure 110 (discussed further below).

As shown, the electrode pairs 150, 160 are separated by a dielectric or insulating material 140. The electrodes 150, 160 of the pair of electrodes can be located such that a constant distance is maintained between the two electrodes in some embodiments. In certain embodiments, the electrode pairs are maintained at a potential bias using steady, pulsed direct, or alternating current. Accordingly, when a voltage potential is applied across one of the pair of electrodes 150, 160, a plasma discharge is produced that induces air flow in a plasma channel. For example, when the plasma discharge is produced, an electrohydrodynamic (EHD) body force is generated which induces air flow in the plasma channel in various embodiments. In a further embodiment, a plurality of such actuators 100 may be used. A voltage potential can be applied to each actuator 100 in timed phases. For example, in one embodiment, three or more electrodes can be positioned in the plasma channel and powered in phased pairs. In certain embodiments, a serpentine plasma actuator can incorporate a pair of electrodes, where at least one of the pair of electrodes has a serpentine shape. Then, at least one serpentine electrode can have one or more turns.

In accordance with the present disclosure, a novel membrane structure 110 is provided at, adjacent to, or near an end of the plasma actuator assembly adjacent or near to a top electrode 160, in one embodiment. An exemplary membrane structure 110 comprises a series of parallel nano-sized support members 115 that are coated with a nitrogen-phobic (or nitrophobic ($N_2$-phobic)) material 117 that repels nitrogen molecules (represented by square shaped particles in the figure) in the atmosphere, thereby allowing oxygen molecules (represented by spherical shaped particles in the figure) to pass through cylindrical column passageways or channels between the parallel support members 115 (e.g., with diameters in the range of one nanometer and relatively smooth walls).

By doing so, oxygen-enriched air is introduced and present near the surface or exposed electrode 160 of the plasma actuator 100. The plasma discharge forms at or near the exposed surface of the electrode 160, which is also where the oxygen enriched environment/low-pressure oxygen enriched environment is created via techniques of the present disclosure. Therefore, the plasma actuator 100 gains momentum and benefit from the enriched oxygen by producing plasma flows with more force as compared to standard plasma actuators 100. Possible applications and industries that can benefit from such improved flows include those that utilize large vehicles, such as aircrafts, buses, trucks, etc.

Correspondingly, at a bottom surface 180 of the plasma actuator 100 (and membrane structure 110), nitrogen molecules from the surrounding air are rejected from passing or permeating through the membrane structure 110. However, oxygen molecules from the surrounding air passes through the column or vertical channels of the membrane structure 110 to the top surface causing the top atmospheric conditions to become more oxygen enriched and nitrogen depleted. In this way, the membrane structure 110 acts as a "smart gate" in selectively accepting oxygen particles and rejecting nitrogen particles from the surrounding air.

Figure 2:
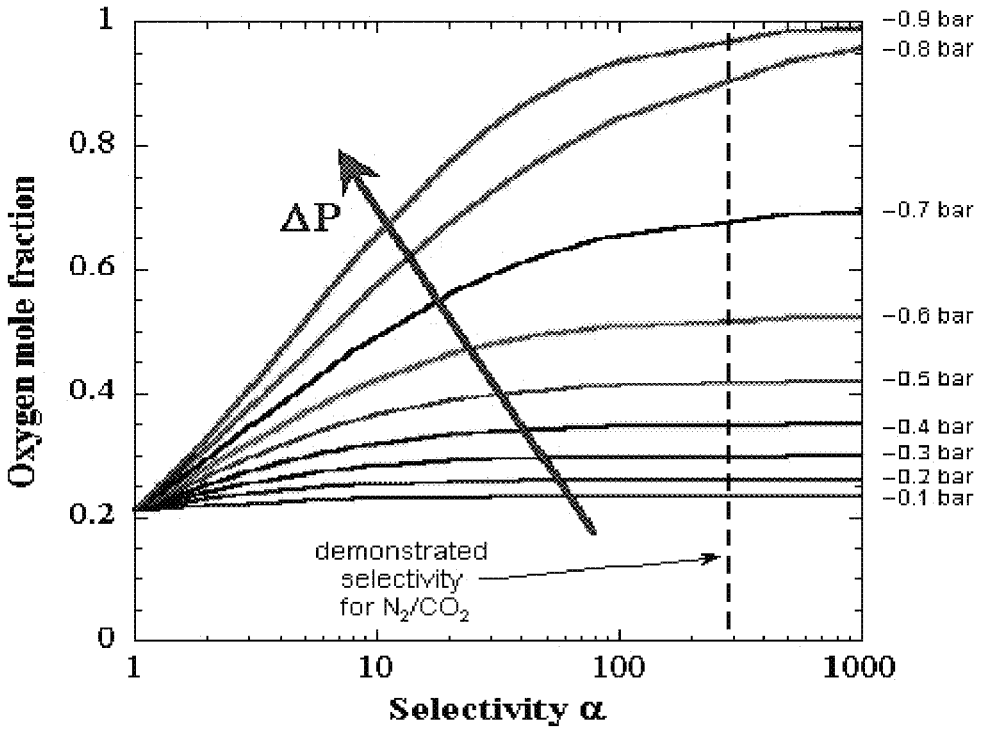
FIG. 2 is a graph showing gas selectivity, $O_2$ mole fraction concentration, and pressure differential measurements for the embodiment of the plasma actuator of FIG. 1.

Next, FIG. 2 shows a graph of the gas selectivity (rate of $O_2$/rate of $N_2$), $O_2$ mole fraction concentration, and pressure differential measurements for the embodiment of the plasma actuator 100 (FIG. 1). By depleting nitrogen from one side/surface and pumping more oxygen to the other side/surface, a significant pressure differential is created between the two surfaces of the membrane structure 110 due to nitrogen repulsion.

Increased plasma force is due to a substantial increase in oxygen particle concentration in the atmosphere. Experimental evidence suggests that a majority (~98%) of plasma generated electric force is due to atomic and molecular oxygen gas, and its metastable and ionized forms. Therefore, a nitrophobic surface of the membrane structure 110 increases oxygen concentration in a scalable fashion helping to improve plasma force. However, bulk material density of the plasma actuator 100 is not affected, since an extremely thin layer of nitrophobic coating 117 on the membrane 110 (e.g., a few monolayers to 100 nm or possibly less) is applied in certain embodiments. Thus, nitrophobic plasma actuator technology is to become valuable to the flow control and propulsion community, such as the aerospace and automobile industry, among other possible industries or fields (e.g., wound therapy (plasma bandage) taking advantage of gas separation in the medical field).

Figure 3:
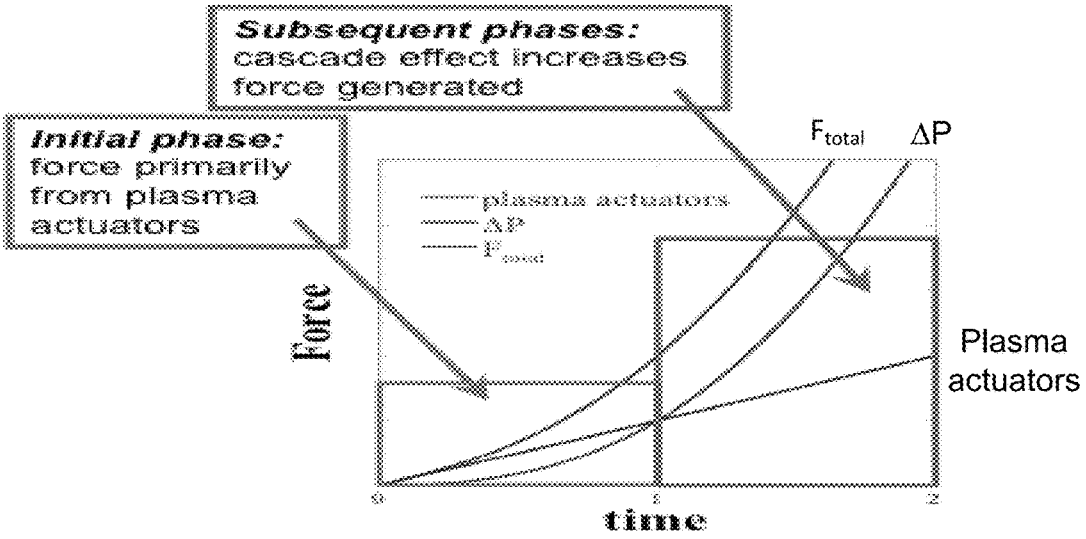
FIG. 3 is a chart showing the cascade effect of force created by the plasma actuator of FIG. 1.

The force of the plasma flow is shown to increase over time in the chart of FIG. 3. In an initial phase, force of the plasma flow is primarily attributed to the electrohydrodynamic (EHD) body force that results from the electric field lines that are generated between electrodes 150, 160 of the plasma actuator 100. Therefore, a cascading effect starts with local reduction of pressure due to flow actuation that in turn starts the process to repel $N_2$ to further reduce the pressure to further actuate the flow. The net effect is a significant pressure differential that can be useful for many practical applications.

Consider that a small change in $O_2$ mole fraction can significantly bias the surface pressure of the plasma actuator. For example, where an $O_2$ mole fraction of 0.2 is the ratio of oxygen in normal atmospheric conditions, the atmospheric unit of pressure at an $O_2$ mole fraction of 0.2 is 1 bar. By increasing the $O_2$ mole fraction slightly to 0.21, a pressure differential measurement of −0.1 bar results which corresponds to a pressure drop of 10,000 Pascals ($N/m^2$). Thus, a small change in balance between oxygen and nitrogen concentrations generates a large pressure differential. As an illustration, if the top surface of the plasma actuator 100 is singularly surrounded by oxygen on the top surface (i.e., an atmosphere of pure oxygen), the $O_2$ mole fraction would be 1.0 and the resulting pressure differential would exceed −0.8 bar for a pressure drop of 80,000 Pascals ($N/m^2$) which is quite significant or extreme.

Referring back to FIG. 1, velocity that is induced by the generated air flow (top surface of FIG. 1) of the plasma actuator 100 creates movement of the plasma. This movement creates a small pressure drop $\Delta P$ (e.g., 1 Pa) on one side of the plasma actuator 100 that is large enough to create a suction force starting through the membrane structure 110. As a result, a selective process commences where more oxygen particles are moved to the top surface causing a cascading effect to start, as represented in FIG. 3. Therefore, as more oxygen is enriched on a top surface of the plasma actuator 100 by the membrane structure 110, more plasma is generated increasing the force of the plasma flow by the plasma actuator 100. Additional pressure differential is then created across the membrane structure 110 increasing the suction force through the membrane structure 110.

In subsequent phases, the cascade effect due to the oxygen enriched environment generated by characteristics of the membrane structure 110 increases the force generated by the plasma flow. Potentially, the cascading effect in an embodiment of a nitrophobic plasma actuator 100 can exponentially increase force production due to the pressure differential $\Delta P$. Embodiments of the present disclosure therefore can control the force production by deactivating the plasma actuator 100 (via a control mechanism 190, such as an electrical switch) so that there is no longer a local pressure drop downstream on an outlet/top side of the membrane structure 110 causing the production of oxygen to reduce and gradually stop along with the pressure differential.

In an exemplary embodiment, the membrane structure 110 of the present disclosure induces single-file diffusion for atmospheric particles, such as oxygen. Since the nitrogen molecule is larger in size than the oxygen molecule, passage of nitrogen molecules can be restricted through the membrane structure 110 by limiting the size of the column passageways or channels to not allow nitrogen molecules to pass. In one embodiment, a channel diameter of the membrane structure 110 corresponds to be less than the size of a nitrogen ($N_2$) molecule (but larger than the size of an oxygen molecule), thereby restricting access of nitrogen molecules, while allowing oxygen molecules to pass. The flux of the smaller component through the membrane 110 will be drastically enhanced by restricting access of nitrogen molecules into the membrane channels acting as a specially designed smart gate within the membrane structure 110.

Accordingly, membrane(s) 110 with dimensions suitable for single-file diffusion are integrated with highly-selective nitrophobic polymers in certain embodiments. In one embodiment, the single-file separation strategy is combined with smart gate functionality that restricts the flow of nitrogen particles into the channels as part of the membrane structure 110. This drastically reduces the concentration of nitrogen in the membrane 110, resulting in significant increases to the flux of oxygen particles, by avoiding frequent collisions between larger molecules ($N_2$) and the smaller component ($O_2$) in the channels which can lead to a relatively low flux of the smaller component through the channels in other arrangements.

Figure 4:
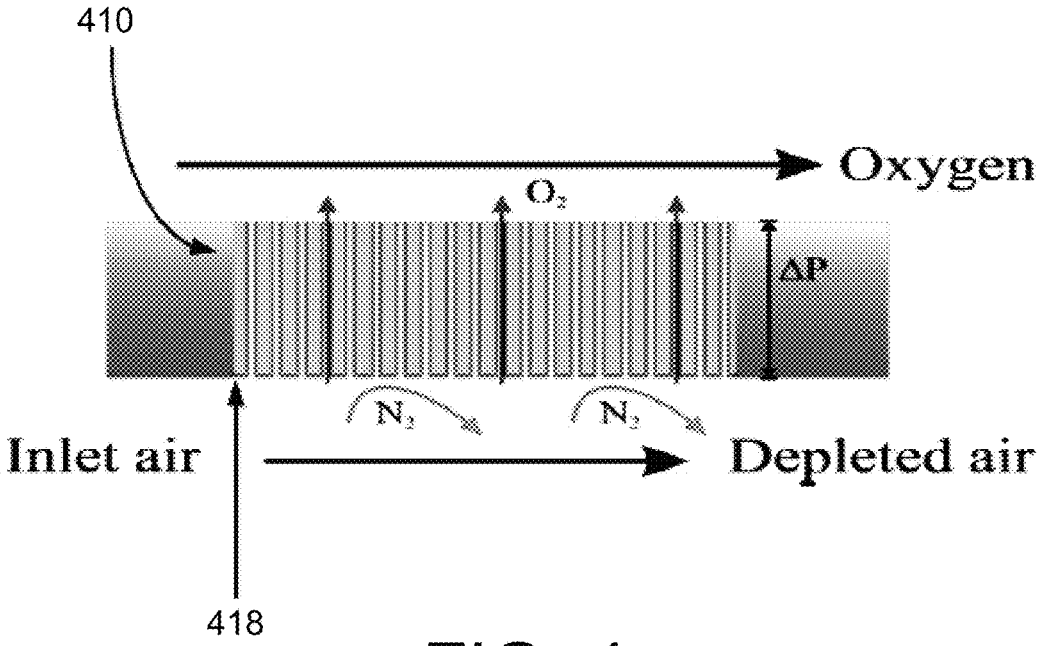
FIGS. 4-5 are diagrams showing exemplary embodiments of a membrane structure for the plasma actuator of FIG. 1.

As demonstrated in FIG. 4, an exemplary embodiment of a plasma actuator 100 includes a membrane structure 410, 110 having porous channels and a thin film on the inlet side coated with a nitrophobic material that hinders the introduction of the nitrogen ($N_2$) into the porous channels. Because nitrophobic materials exclude $N_2$, such materials are ideal for the separation of air. Hence, the single-file separation strategy combined with smart gates based on nitrophobic coatings 117 can result in a remarkably high selectivity and, at the same time, yield a high oxygen flux suitable for operation in plasma actuators 100.

In particular, an embodiment of the membrane structure shown in FIG. 4 is based on single-file diffusion, where nitrophobic coating 418, 117 repels $N_2$ from an inlet, lowering the concentration of $N_2$ in the channels dramatically. Within the channel, single-file diffusion is used to provide further separation of the oxygen molecules.

In an exemplary embodiment, the nitrophobic coating 418, 117 is a material based on azo-linked polymers, e.g. azo-covalent organic polymer material. Further, the membrane structure 410, 110 may have a porous/dimpled/corrugated surface to enhance surface area for plasma generation which enables more ionization. Such surface modification acts to exploit molecular differences of $N_2$ and $O_2$. Certain embodiments of the plasma actuator provide 3-100 times improvement in plasma force by nitrogen rejection. Where standard plasma actuators can only produce milli-Newton level force, novel plasma actuators in accordance with the present disclosure can produce several Newton forces.

Figure 5:
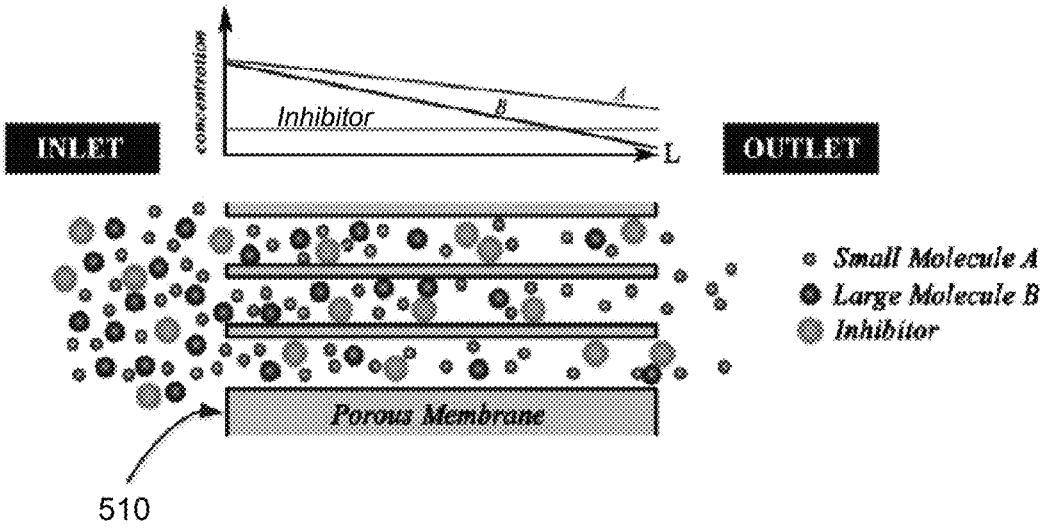

In an alternative embodiment, rather than fine-tune the channel diameter with a precision in the range of a fraction of the size of a $N_2$ molecule, an inhibitor (<1 wt %) to the normal diffusion of $N_2$ within the channels is used with the membrane structure 510, 110, as shown in FIG. 5. Accordingly, in one embodiment, inhibitor molecules concentrated in the membrane coating 117 and/or support members 115 act to inhibit the normal diffusion of $N_2$ within the membrane structure 110 while the diffusion of $O_2$ is not affected. These inhibitor molecules have diameters similar to the membrane channels but their movement will be limited to single-file diffusion because they are too large to pass one another in the channels.

As discussed above, the nitrophobic coating 418, 117 may be based on azo-linked polymers, e.g. azo-covalent organic polymer material. Thus, in various embodiments, nitrophobic polymers containing azo functional groups may be synthesized. Correspondingly, in one exemplary embodiment, synthesized organic polymers that selectively exclude $N_2$ through incorporation of azo-bridges (azo-COPS) may be used as a form of nitrophobic coating 418, 117, as shown by the structural material representations depicted in FIG. 6A. Such materials are stable in air to 350° C. and boiling water. Further, these nitrophobic materials can potentially lead to order of magnitude increases in selectivity.

Figure 6A:
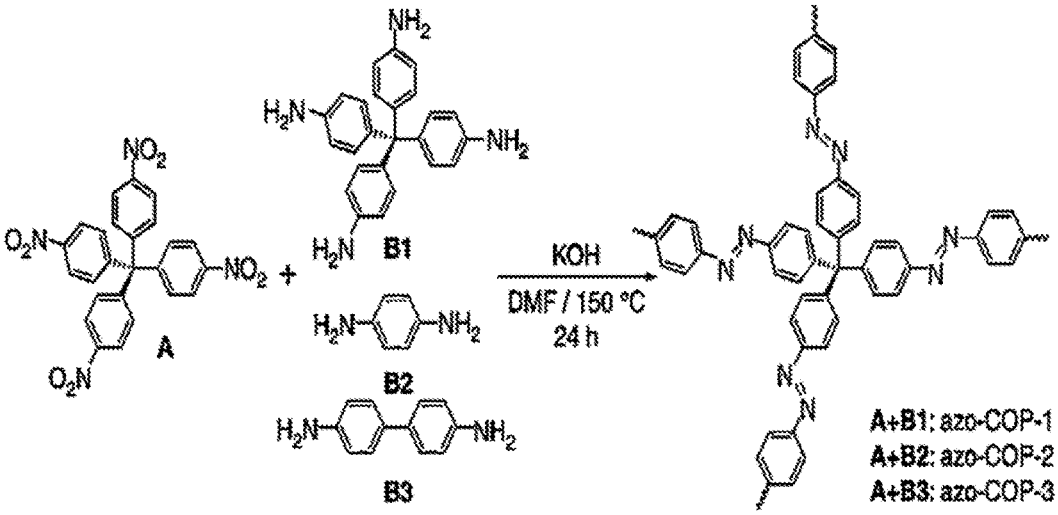
FIG. 6A is a diagram of a structural material representation of azo-bridges that may be used in nitrophobic coatings in various embodiments of the present disclosure.
Figure 6B:
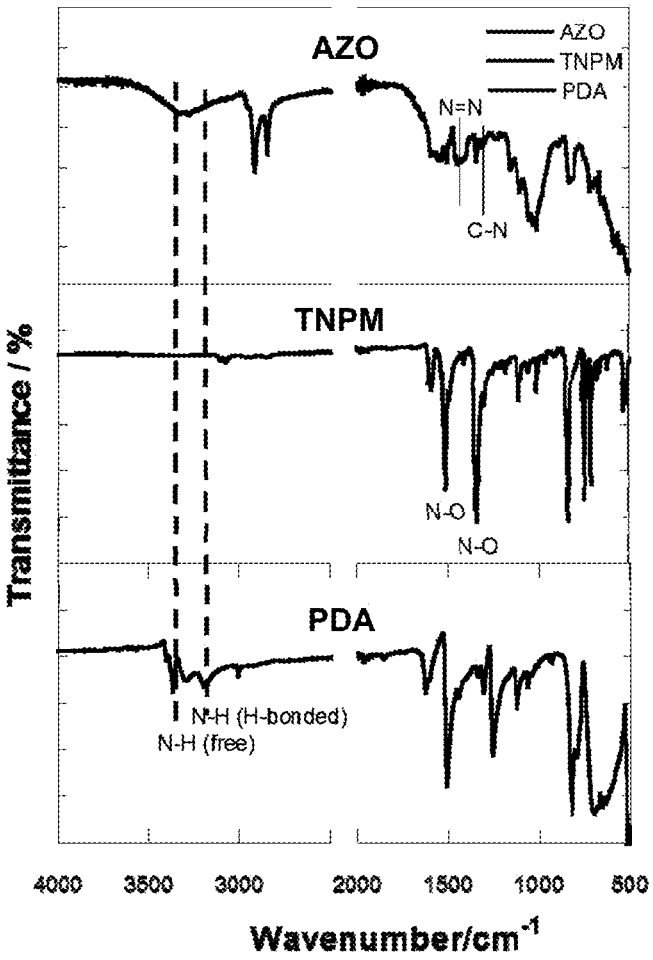
FIG. 6B is a chart of Fourier Transform Infrared Data for an azo-membrane material (azo-COP-2) in accordance with embodiments of the present disclosure.
Figure 6C:
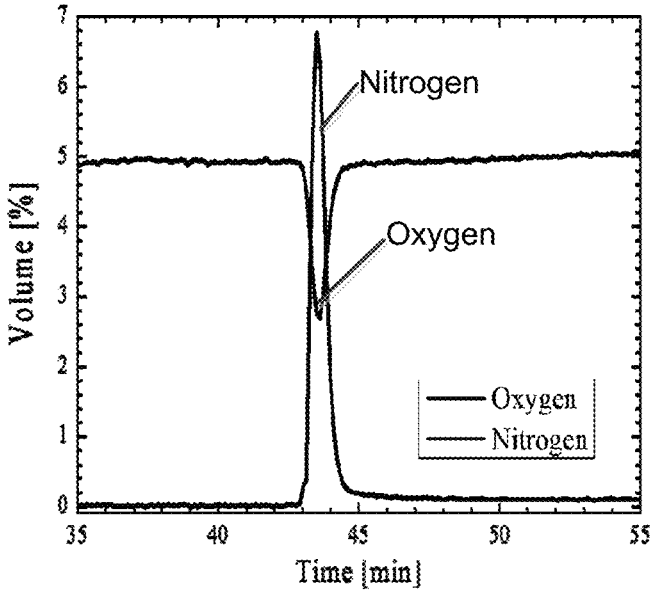
FIG. 6C is a chart of absorption data for the azo-membrane material of FIG. 6B.

Corresponding FTIR (Fourier Transform Infrared) data in FIG. 6B confirms the synthesis capabilities of the formation of azo-COP-2 from the precursors tetrakis (4-nitrophenyl) methane (TNPM) and p-phenenylene (PDA), in accordance with an exemplary embodiment, where the synthesized organic polymer may be further formed into a composite that can be used as the basis of a membrane structure 410, 110. To obtain absorption data, the sample was outgassed in Helium (He) at 140° C. while monitoring the effluent using a mass spectrometer (MS). Once the baseline values for $O_2$, $N_2$ and $H_2O$ MS were achieved during outgassing, the polymer composite was exposed to 5% $O_2$ in He (although the lines had residual $N_2$). Accordingly, the absorption data represented in the chart of FIG. 6C show that a sharp decrease in the $O_2$ signal was observed, indicating a significant $O_2$ uptake into the composite material (azo-COP-2), while the $N_2$ signal increased simultaneously. These results clearly indicate the synthesized polymer sample does indeed absorb $O_2$ preferentially over $N_2$.

Figure 7A:
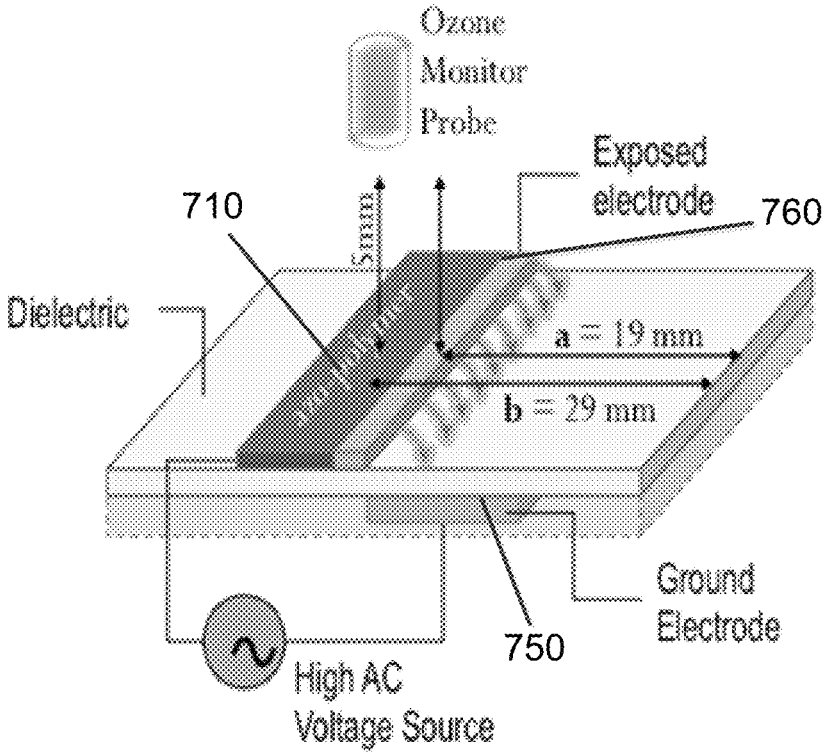
FIG. 7A is a diagram of a plasma actuator having a nitrophobic surface membrane structure formed of an azo-COP-2 polymer in accordance with an exemplary embodiment.

Next, a study of the influence of an azo-COP-2 polymer (as shown in FIG. 6A) on plasma actuation is discussed. For the study, a plasma actuator having at least one exposed electrode 760, 160 and one encapsulated or buried electrode 750, 150 was built as shown in FIG. 7A. The azo-membrane 710, 110 was placed just upstream of the exposed electrode 760 as shown in the figure schematic. Ozone levels during and after plasma generation were measured using a 2B Tech® Ozone Monitor (Model 202). The measurement of ozone was based on absorption of UV (ultraviolet) light (at 254 nm) and subsequent comparison of the quanta of light reaching the detector before and after absorption by ozone. Ozone levels were measured in units of ppbv (parts per billion per volume). Air inside the chamber was sampled every 10 seconds and measured ozone levels were saved to a computer via a LabView® interface.

Figure 7B:
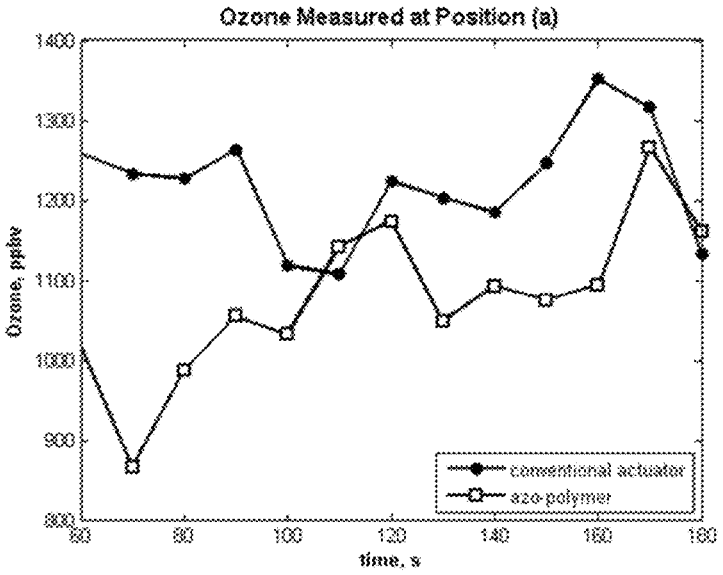
FIGS. 7B-7C are charts showing ozone concentrations collected at certain locations of the plasma actuator of FIG. 7A.
Figure 7C:
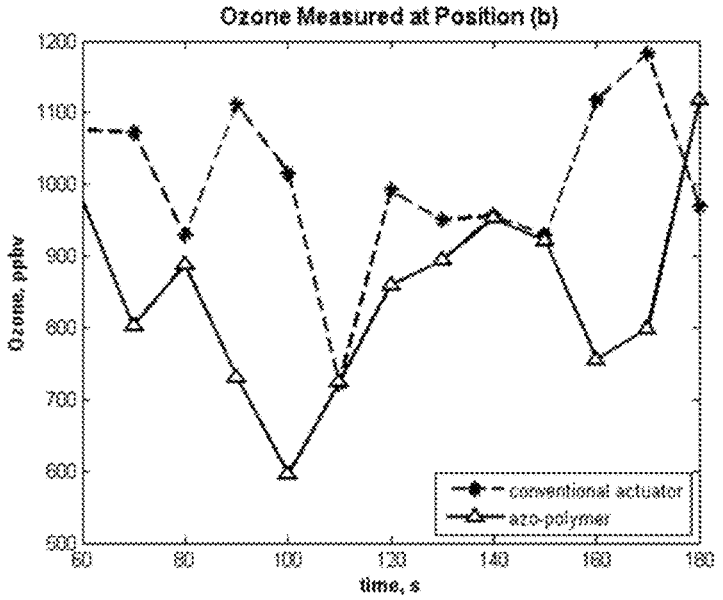

Referring next to the charts of FIGS. 7B and 7C, preliminary data was collected for ozone concentration at two locations (a) and (b) (shown in FIG. 7A). In particular, FIG. 7B shows ozone concentration at location (a) and FIG. 7C shows the ozone concentration at location (b) in FIG. 7A. From the figures, the data shows the distinct influence of azo-membrane in reducing ozone (reactive oxygen species).

Figure 8:
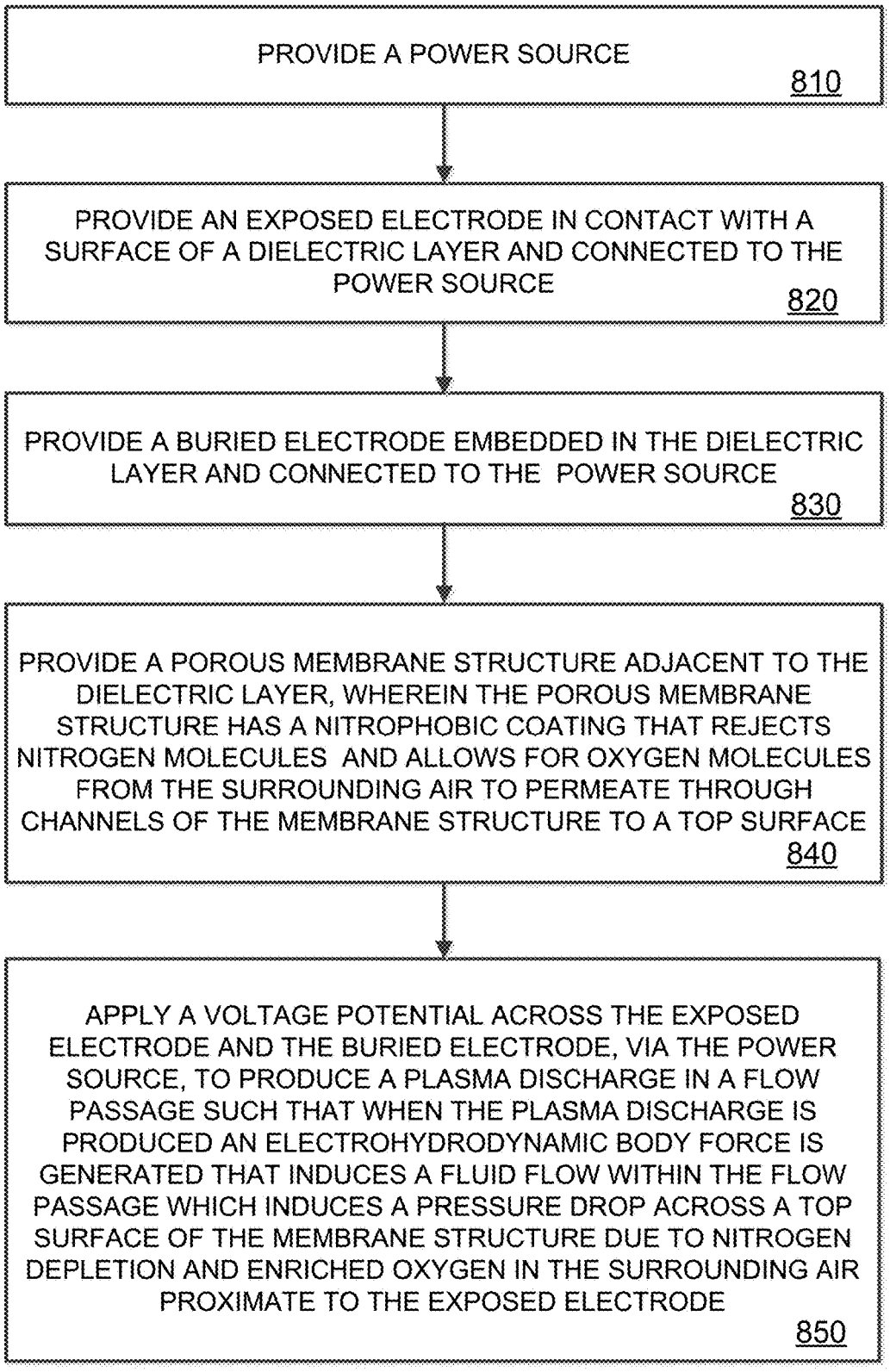
FIG. 8 is a flow chart diagram illustrating a method of plasma actuation in accordance with an embodiment of the present disclosure.

Next, FIG. 8 illustrates a method of plasma actuation in accordance with an embodiment of the present disclosure. An exemplary method comprises providing (810) a power source 170; providing (820) an exposed electrode 160 in contact with a surface of a dielectric layer 140 and connected to the power source 170; providing (830) a buried electrode 150 embedded in the dielectric layer 140 and connected to the power source 170; providing (840) a porous membrane structure 110 adjacent to the dielectric layer 140, wherein the porous membrane structure 110 has a nitrophobic coating 117 that rejects nitrogen molecules from surrounding air and allows for oxygen molecules from the surrounding air proximate to a bottom surface of the membrane structure 110 to permeate through channels of the membrane structure 110 to a top surface; and applying (850) a voltage potential across the exposed electrode 160 and the buried electrode 150, via the power source 170, to produce a plasma discharge in a flow passage, such that when the plasma discharge is produced an electrohydrodynamic body force is generated that induces a fluid flow within the flow passage which induces a pressure drop across a top surface of the membrane structure 110 due to nitrogen depletion and enriched oxygen in the surrounding air proximate to the exposed electrode 160.

It should be emphasized that the above-described embodiments of the present disclosure are merely possible examples of implementations, merely set forth for a clear understanding of the principles of the disclosure. Many variations and modifications may be made to the above-described embodiment(s) without departing substantially from the spirit and principles of the present disclosure. All such modifications and variations are intended to be included herein within the scope of this disclosure and protected by the following claims.

Therefore, at least the following is claimed:

1. A plasma actuator comprising:
a dielectric layer;
a buried electrode embedded within the dielectric layer;
an exposed electrode located on a surface of the dielectric layer, wherein the buried electrode and the exposed electrode are electrically connected; and
a porous membrane structure adjacent to the dielectric layer, wherein the porous membrane structure has a nitrophobic coating that rejects nitrogen molecules from surrounding air and allows oxygen molecules from the surrounding air proximate the porous membrane structure to permeate through channels of the membrane structure to a top surface of the exposed electrode.

2. The plasma actuator of claim 1, wherein the nitrophobic coating comprises an azo-covalent organic polymer material with nitrogen selectivity.

3. The plasma actuator of claim 1, wherein the porous membrane structure comprises azo-COP-2.

4. The plasma actuator of claim 1, wherein the porous membrane structure comprises a series of parallel nano-sized support members that repel nitrogen molecules in a surrounding atmosphere, thereby allowing oxygen molecules from the surrounding atmosphere to pass through column channels between the parallel support members.

5. The plasma actuator of claim 1, further comprising a voltage source electrically connected to the exposed electrode and the buried electrode.

6. The plasma actuator of claim 5, wherein the membrane structure creates a pressure drop on a top surface of the plasma actuator upon activation of the voltage source.

7. The plasma actuator of claim 5, further comprising a control mechanism configured to activate and deactivate the voltage source.

8. The plasma actuator of claim 1, wherein each of the exposed electrode and the buried electrode has at least one turn formed therein.

9. The plasma actuator of claim 1, wherein the membrane structure further comprises an inhibitor material that acts to inhibit normal diffusion of nitrogen within the membrane structure.

10. The plasma actuator of claim 1, wherein the membrane structure further has a corrugated surface.

11. A method of plasma actuation comprising: providing a power source;
providing an exposed electrode in contact with a surface of a dielectric layer and connected to the power source;
providing a buried electrode embedded in the dielectric layer and connected to the power source;
providing a porous membrane structure adjacent to the dielectric layer, wherein the porous membrane structure has a nitrophobic coating that rejects nitrogen molecules from surrounding air and allows oxygen molecules from the surrounding air proximate to a bottom surface of the membrane structure to permeate through channels of the membrane structure to a top surface; and
applying a voltage potential across the exposed electrode and the buried electrode, via the power source, to produce a plasma discharge in a flow passage, such that when the plasma discharge is produced an electrohydrodynamic body force is generated that induces a fluid flow within the flow passage which induces a pressure drop across a top surface of the membrane structure due to nitrogen depletion and enriched oxygen in the surrounding air proximate to the exposed electrode.

12. The method of claim 11, wherein the pressure drop contributes to an increased force of the fluid flow within the flow passage.

13. The method of claim 11, further comprising inducing a cascading effect of the fluid flow, wherein a force of the fluid flow increases over time.

14. The method of claim 11, wherein the nitrophobic coating comprises an azo-covalent organic polymer material with nitrogen selectivity.

15. The method of claim 11, wherein the porous membrane structure comprises a series of parallel nano-sized support members that repel nitrogen molecules in a surrounding atmosphere, thereby allowing oxygen molecules from the surrounding atmosphere to pass through column channels between the parallel support members.

16. The method of claim 11, further comprising further comprising deactivating the power source to discontinue a buildup of force of the fluid flow within the flow passage.

17. The method of claim 11, wherein each of the exposed electrode and the buried electrode has at least one turn formed therein.

18. The method of claim 11, wherein the membrane structure further comprises an inhibitor material that acts to inhibit normal diffusion of nitrogen within the membrane structure.

19. The method of claim 11, wherein the porous membrane structure comprises azo-COP-2.

20. The method of claim 19, further comprising synthesizing the porous membrane structure from precursors tetrakis (4-nitrophenyl) methane (TNPM) and p-phenenylene (PDA).

* * * * *